US009568170B2

(12) United States Patent
Xu

(10) Patent No.: US 9,568,170 B2
(45) Date of Patent: Feb. 14, 2017

(54) LIGHT FIXTURE WITH SUPPORT STRUCTURE

(71) Applicant: DONGGUAN JIASHENG LIGHTING TECHNOLOGY CO., LTD., Dongguan, Guangdong Province (CN)

(72) Inventor: Shuisheng Xu, Dongguan (CN)

(73) Assignee: DONGGUAN JIASHENG LIGHTING TECHNOLOGY CO., LTD., Dongguan, Guangdong Province (CN)

( * ) Notice: Subject to any disclaimer, the term of this patent is extended or adjusted under 35 U.S.C. 154(b) by 260 days.

(21) Appl. No.: 14/339,568

(22) Filed: Jul. 24, 2014

(65) Prior Publication Data

US 2015/0292717 A1 Oct. 15, 2015

(30) Foreign Application Priority Data

Apr. 9, 2014 (CN) ..... 2014 2 0170669 U

(51) Int. Cl.

| | |
|---|---|
| ***F21V 21/088*** | (2006.01) |
| ***F21V 17/16*** | (2006.01) |
| *F21S 8/02* | (2006.01) |
| *F21V 29/74* | (2015.01) |

(52) U.S. Cl.

CPC ..... *F21V 17/162* (2013.01); *F21S 8/02* (2013.01); *F21V 29/74* (2015.01)

(58) Field of Classification Search

CPC ..... F21V 17/06; F21V 17/16; F21V 17/164; F21V 19/004; F21V 19/0045; F21V 21/044; F21V 21/088

See application file for complete search history.

(56) References Cited

U.S. PATENT DOCUMENTS

| | | | | | |
|---|---|---|---|---|---|
| 1,589,760 | A * | 6/1926 | Kuen | F21S 48/1208 | 362/374 |
| 2,960,361 | A * | 11/1960 | Boutelle | F16B 5/06 | 292/17 |
| 3,872,296 | A * | 3/1975 | Cohen | F21V 17/164 | 248/343 |
| 4,039,822 | A * | 8/1977 | Chan | F21S 8/02 | 362/183 |
| 4,431,151 | A * | 2/1984 | Schonasky | G12B 9/00 | 248/27.1 |
| 4,475,147 | A * | 10/1984 | Kristofek | F21S 8/026 | 362/147 |

(Continued)

*Primary Examiner* — Ismael Negron

(74) *Attorney, Agent, or Firm* — Jackson IPG PLLC; Demian K. Jackson

(57) ABSTRACT

A lighting fixture includes a lamp body, a frame, and a light source is provided on the lamp body. Two bosses are provided on opposite sides of the outer wall of the lamp body. The frame includes a frame body, with positioning holes being provided at positions on the frame body corresponding to the bosses, and engaging seats corresponding to the positioning holes. The lighting fixture further includes at least two elastic sheets each including a main body portion and a buckle portion connected to the main body portion, an obliquely protruded tongue being provided on the main body portion, a neck and a fork being provided on the buckle portion. The main body portions of the elastic sheet are inserted into the engaging seats of the frame body and fixed in the positioning holes by the tongues.

10 Claims, 10 Drawing Sheets

(56) References Cited

U.S. PATENT DOCUMENTS

| | | | | | |
|---|---|---|---|---|---|
| 5,707,143 | A * | 1/1998 | Hentz | F21S 8/02 | 362/147 |
| 5,941,625 | A * | 8/1999 | Morand | F21S 8/02 | 248/343 |
| 6,361,193 | B1 * | 3/2002 | Gabrius | F21S 8/02 | 362/147 |
| 6,830,362 | B2 * | 12/2004 | Mullen | F21V 17/164 | 362/455 |
| 7,909,487 | B1 * | 3/2011 | Venetucci | F21S 8/02 | 362/147 |
| 7,972,043 | B2 * | 7/2011 | Schutte | F21S 8/02 | 362/147 |
| 8,118,455 | B2 * | 2/2012 | Cowan | F21V 17/164 | 362/306 |

* cited by examiner

LIGHT FIXTURE WITH SUPPORT STRUCTURE

FIELD OF THE INVENTION

The present invention relates to a lighting device, and particularly to a lighting fixture that is fixed by elastic sheets and convenient in mounting.

BACKGROUND OF THE INVENTION

For fixtures in the prior art, a lamp body is usually fixed on a frame by screws or rivets. However, the fixation by screws requires screws, nuts, gaskets and many other components and is tedious; furthermore, the lamp body is likely to fall off after multiple times of dismounting or mounting, thereby resulting in safety hazards. With regard to the riveting by rivets, riveting equipment and a large operation space are required for stretching and riveting, and it is difficult to dismount after riveting, so it is very inconvenient.

SUMMARY OF THE INVENTION

Hence, an object of the present invention is to provide a lighting device that is simple in structure and convenient for mounting.

A lighting fixture is provided, including a lamp body and a frame, a light source being provided on the lamp body. Two opposite sides of the outer wall of the lamp body are provided with bosses, respectively. The frame includes a frame body, with positioning holes being provided at positions on the frame body corresponding to the bosses, and the frame body further includes engaging seats corresponding to the positioning holes. The lighting fixture further includes at least two elastic sheets each including a main body portion and a buckle portion connected to the main body portion, an obliquely protruded tongue being provided on the main body portion, a neck and a fork being provided on the buckle portion. The main body portions of the elastic sheets are inserted into the engaging seats of the frame body and fixed in the positioning holes by the tongues, the bosses being disposed in the necks of the buckle portions, the forks being elastically against the corresponding bosses, the buckle portions of the elastic sheets being against the outer wall of the lamp body.

Further, the buckle portions are provided with two slots communicated with the necks, and the slots are positioned on two opposite sides of the forks, respectively, to increase the elasticity of the forks.

Further, the bosses are cylindrical, and the bottom edges of the forks are concave arcs to correspondingly lean against the bosses.

Further, the buckle portions include arc elastic portions for connecting to the tops of the main body portions, and the buckle portions, the elastic portions and the main body portions are in an inverse V shape.

Further, each engaging seat includes two positioning bars that are disposed on two opposite sides of the corresponding positioning hole, and a T-shaped socket is formed by the two positioning bars of each engaging seat and the corresponding part of the frame body.

Further, each positioning bar is a vertical bar and includes a connection portion connected to the frame body and a stop portion extending from the outer edge of the connection portion to the other positioning bar, and each positioning bar has an L-shaped cross section.

Further, each engaging seat is disposed on the outside surface of the frame body, and the tongue in the main body portion of each elastic sheet obliquely extends toward the buckle portion.

Further, the buckle portions include arc elastic portions for connecting the tops of the main body portions, and the elastic portions span over the top edges of the frame body to connect the main body portions and the buckle portions, respectively.

Further, each elastic sheet further includes an operating portion including an arc portion for connecting the bottom of the main body portion, and notches are provided on two sides of the bottom of the main body portion, respectively.

Further, each engaging seat is disposed on the inside surface of the frame body, and the tongue in the main body portion of each elastic sheet obliquely extends away from the buckle portion.

Compared with the prior art, by inserting the main body portions of the elastic sheets into the engaging seats of the frame and clamping the bosses on the lamp body via the buckle portions of the elastic sheets, the lighting device provided by the invention is simple and firm in structure, and convenient for mounting; in addition, by the circular arrangement of the bosses and the leaning of the buckle portions against the outer wall of the lamp body, the degree of freedom of turnover and the damping effect of the lamp body relative to the frame are provided.

DETAILED DESCRIPTION OF THE PREFERRED EMBODIMENTS

To show the technical solutions of the present invention more clearly, the present invention will be further described as below with reference to accompanying drawings.

Figure 1:
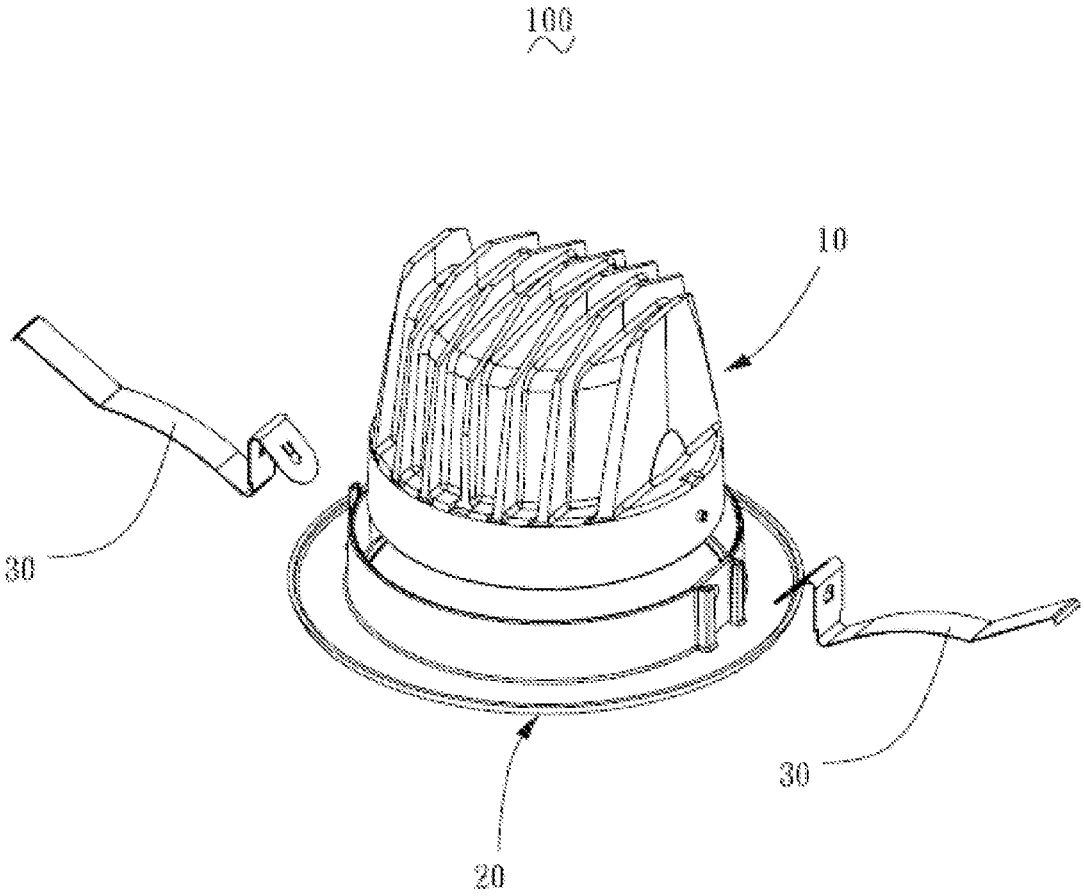
FIG. 1 is a stereoscopic exploded view of a lighting fixture according to a first embodiment of the present invention.
Figure 2:
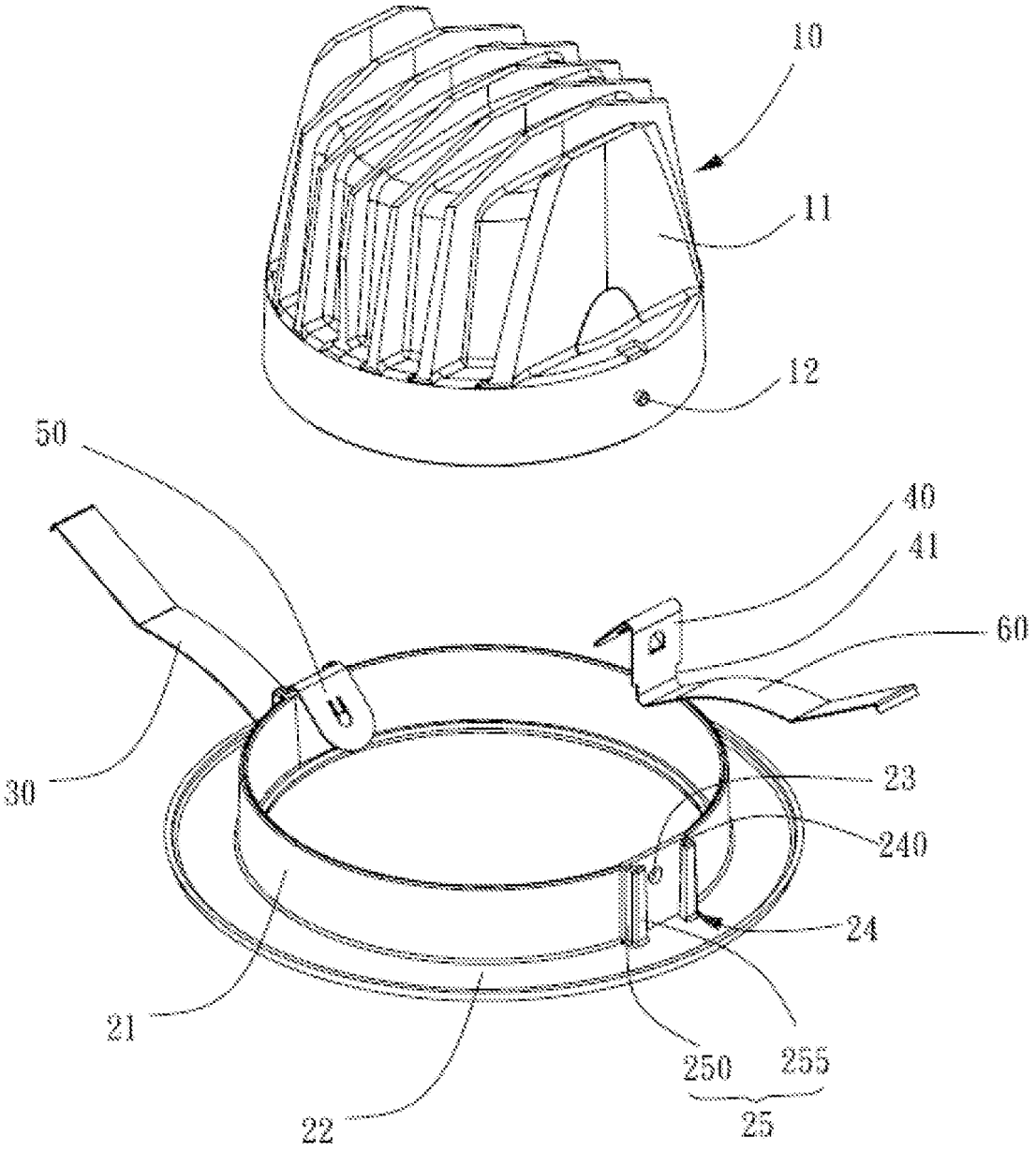
FIG. 2 is a partial assembly diagram of the lighting fixture of FIG. 1.
Figure 3:
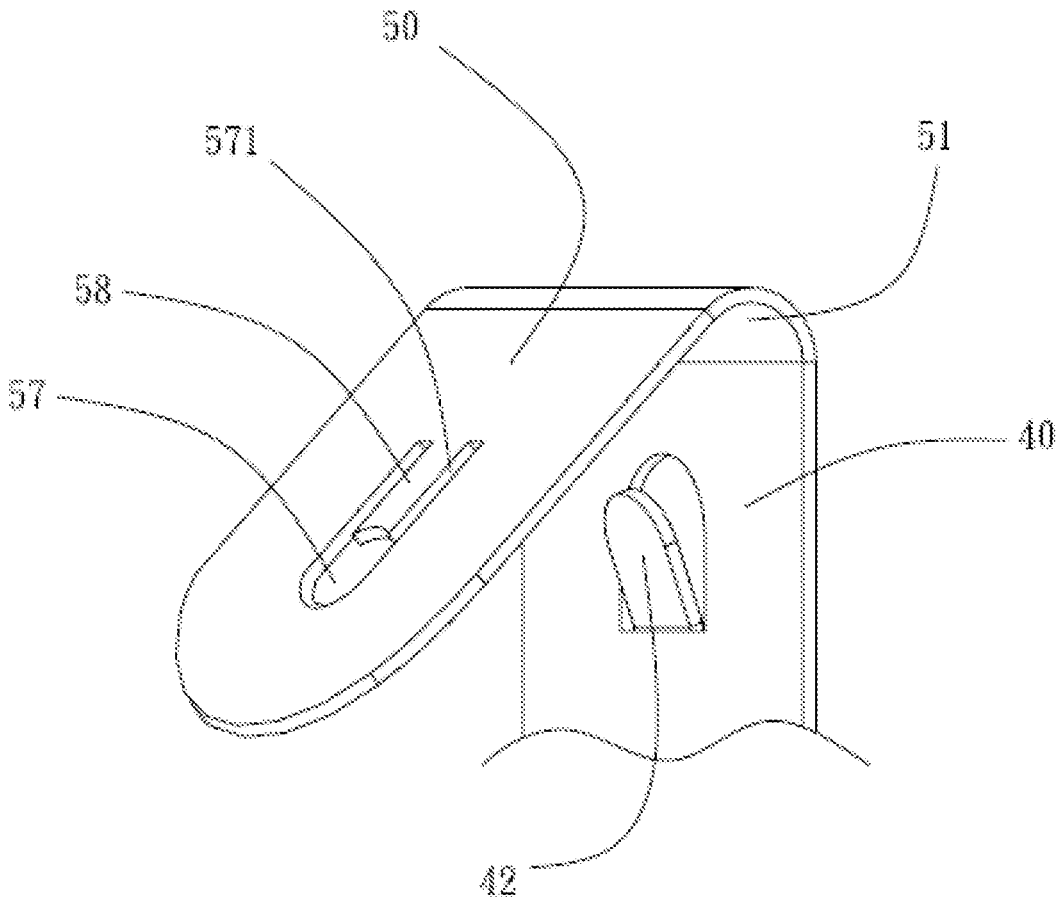
FIG. 3 is an enlarged view of a part of elastic sheets of the lighting fixture of FIG. 1.
Figure 4:
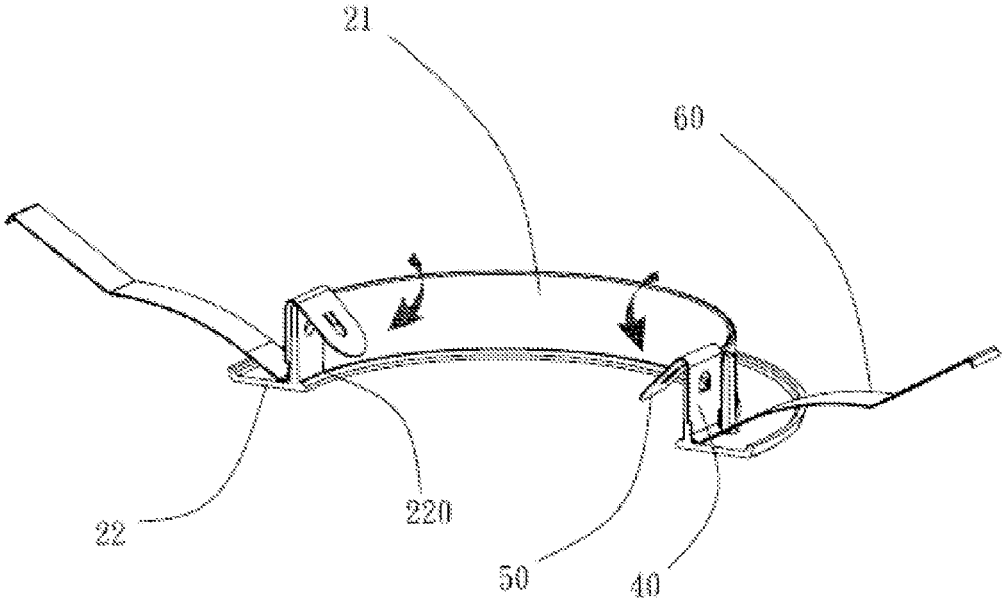
FIG. 4 is a stereoscopic diagram of the lighting fixture of FIG. 1 after splitting half of the frame and mounting the elastic sheets.
Figure 5:
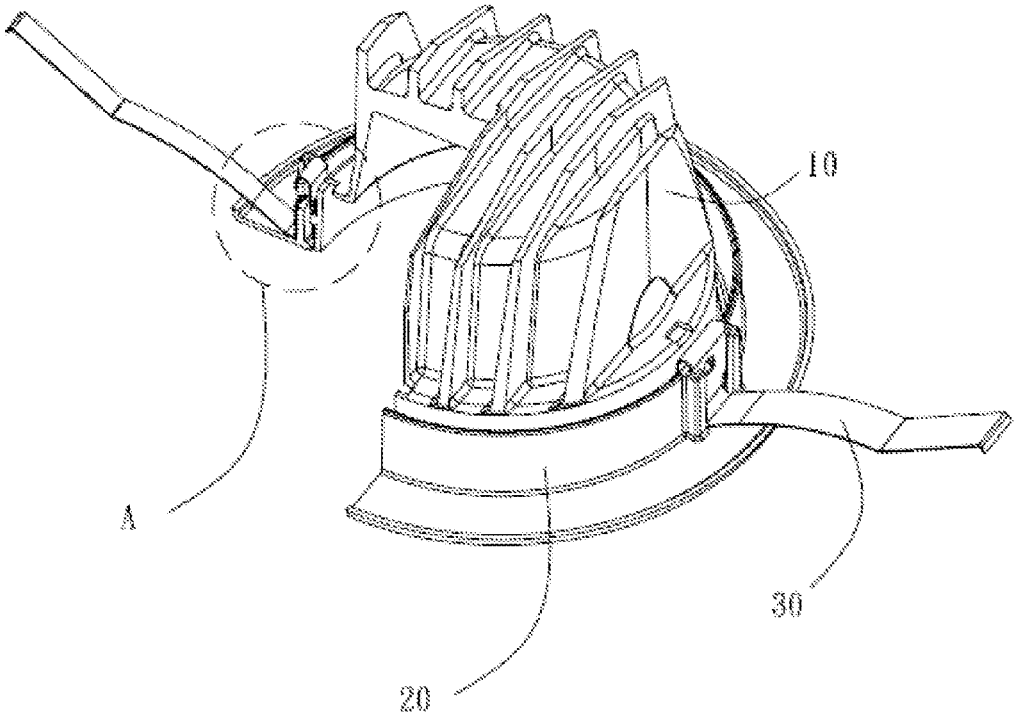
FIG. 5 is a stereoscopic diagram of the assembled lighting fixture of FIG. 1 after removing a quarter thereof.
Figure 6:
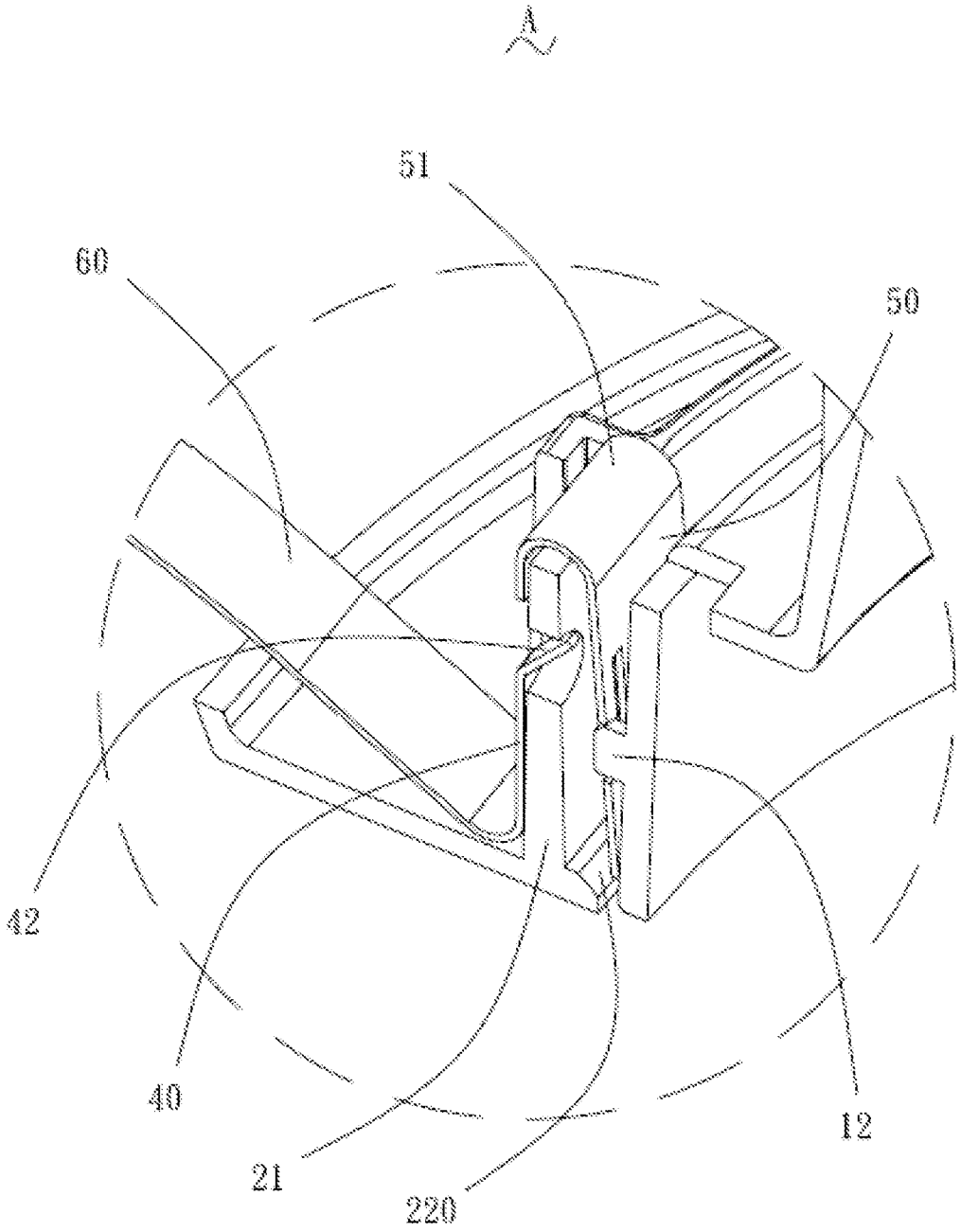
FIG. 6 is an enlarged view of circle part A of FIG. 5.

As shown in FIGS. 1-6, a lighting fixture 100 according to a first embodiment of the present invention is shown. The lighting fixture 100 includes a lamp body 10, a frame 20 and two elastic sheets 30 for connecting the lamp body 10 and the frame 20.

The lamp body 10 includes a light source (not shown) provided therein and a radiator 11. The lamp body 10 is cylindrical in shape. Bosses 12 are extended from two opposite sides of the outer wall of the lamp body 10, respectively. In this embodiment, each boss is cylindrical, and extends perpendicularly to the outer wall of the lamp body 10.

The frame 20 includes a vertically annular frame body 21 and a pedestal 22 connected to the bottom of the frame body 21. The pedestal 22 is cylindrical. Positioning holes 23 are provided on two opposite sides of the frame body 21, respectively. Each positioning hole 23 is a circular through hole. An engaging seat 24 is extended from a position on the frame body 21 corresponding to each positioning hole 23. In the first embodiment, the engaging seats 24 are disposed on the outside surface of the frame body 21. The engaging seats 24 include positioning bars 25 disposed on two opposite sides of the positioning holes 23. Each positioning bar 25 is a vertical bar and includes a connection portion 250 for connecting the frame body 21 and a stop portion 255 extending from the outer edge of the connection portion 250 to the other positioning bar 25, so that the positioning bar 25 has an L-shaped cross section. The bottoms of the engaging seats 24 are connected to the pedestal 22. A T-shaped socket 240 is formed by the two positioning bars 25 of each engaging seat 24 and the corresponding part of the frame body 21. The socket 240 is communicated with the positioning holes 23.

Each elastic sheet 30 includes a main body portion 40, a buckle portion 50 extending inward and downward from the top of the main body portion 40, and an operating portion 60 extending outward from the bottom of the main body portion 40. In this embodiment, each elastic sheet 30 is made of elastic metal material by integral stamping.

Each main body portion 40 is in a shape of rectangular sheet. The width of the main body portion 40 is less than the distance between the two positioning bars 25 of the connection portion 250 and greater than the distance between the two stop portions 255, so that the main body portion 40 may be clamped into the socket 240 of the engaging seat 24. Notches 41 are provided on two sides of the bottom of the main body portion 40, respectively, so that the width of the bottom of the main body portion 40 is less than the distance between the stop portions 255; as a result, the operating portion 60 is allowed to extend into the socket 240 of the engaging seat 24 to connect the main body portion 40. A tongue 42 is extended from the middle of the main body portion 40 towards the buckle portion 50. The top of the tongue 42 is semicircular for correspondingly snapping into the positioning hole 23 of the frame 20. In this embodiment, the bottom of the tongue 42 is connected to the main body portion 40, and a through hole (not shown) is formed at a position on the main body portion corresponding to the tongue 42 by stamping.

Each buckle portion 50 includes an arc elastic portion 51 for connecting the top of the main body portion 40. The buckle portion 50, the elastic portion 51 and the main body portion 40 are in an inverse V shape. In the middle of the buckle portion 50, provided are a neck 57 and a fork 58 located above the neck 57. The buckle portion 50 is also provided with two slots 571. The slots 571 are positioned on two opposite sides of the fork 58 and communicated with the neck 57, so that the fork 58 is connected to the buckle portion 50 only on the top to increase the elasticity of the fork. When the bosses 12 of the lamp body 10 are assembled to the necks 57, the forks 58 play a role of guiding the bosses 12; and when the bosses 12 of the lamp body 10 are to be disassembled from the necks 57, the forks 58 are pressed down to allow the bosses 12 to exit upward. In this embodiment, the bottom edges of the forks 58 are concave arcs.

The operating portion 60 includes an arc portion (not shown) for connecting the bottom of the main body portion 40. The operating portion 60 is bent and extended outward, so that it is convenient for a user to operate the elastic sheets 30.

During assembling, the main body portions 40 of the elastic sheets 30 are inserted into the engaging seats 24 of the frame 20 from up to down, and the tongues 42 of the main body portions 40 are elastically compressed first due to the extrusion of the frame body 21. When the main body portions 40 are completely inserted into the engaging seats 24, the tongues 42 are embedded into the positioning holes 23 of the frame body 21 by bounce. At this time, the buckle portions 50 of the elastic sheets 30 are positioned on the inner side of the frame body 21, and the elastic portions 51 are spanned over the top ends of the frame body 21 to connect the main body portions 40 and the buckle portions 50, respectively. Finally, the lamp body 10 is pressed into the frame body 21 from up to down, where the bosses 12 correspond to the position of the forks 58 of the buckle portions 50.

During the pressing process, the lamp body 10 pushes the buckle portions 50 of the elastic sheets 30 to elastically get close to the inner wall of the frame body 21, and simultaneously the bosses 12 push the corresponding forks 58 to slip into the necks 57. After the bosses 12 are embedded into the necks 57, the buckle portions 50 rebound to support against the bottom of the outer wall of the lamp body 10, and the forks 58 elastically lean against the tops of the bosses 12. As both the bosses 12 and the necks 57 are circular, the lamp body 10 is allowed to be pivoted to the elastic sheets 30, that is, the lamp body 10 may turn over around the axis of the bosses 12 and the necks 57, so that the lamp body 10 has a degree of freedom of turnover relative to the frame 20; meanwhile, after the lamp body 10 rotates about the bosses 12 to a preset turnover angle, the buckle portions 50 rebound to lean against the outer wall of the lamp body 10 so as to generate a frictional resistance for allowing the lamp body 10 to be positioned at the preset turnover angle. It is to be understood that the pedestal 22 extends to the inner side of the frame body 21 and forms a slope 220 for supporting the buckle portions 50, thus to further support the lamp body 10, preventing the lamp body 10 from falling off from the frame body 21 unexpectedly due to excessive stress during the pressing process.

In the lighting fixture 100 provided by the present invention, by arranging the positioning holes 23 and the engaging seats 24 on two opposite sides of the frame 20, inserting the main body portions 40 of the elastic sheets 30 into the engaging seats 24 and clamping the tongues 42 of the main body portions 40 into the positioning holes 23, the elastic sheets 30 are fixed on the frame 20; meanwhile, the buckle portions 50 of the elastic sheets 30 are clamped on the bosses 12 on the lamp body 10 by the necks 57 and the forks 58, so that the lamp body 10 is fixed; in addition, by the circular arrangement of the bosses 12 and the leaning of the buckle portions 50 against the outer wall of the lamp body 10, the degree of freedom of turnover and the damping effect of the lamp body 10 relative to the frame 20 are provided. The lighting fixture 100 is simple and firm in structure, and convenient for mounting.

Figure 7:
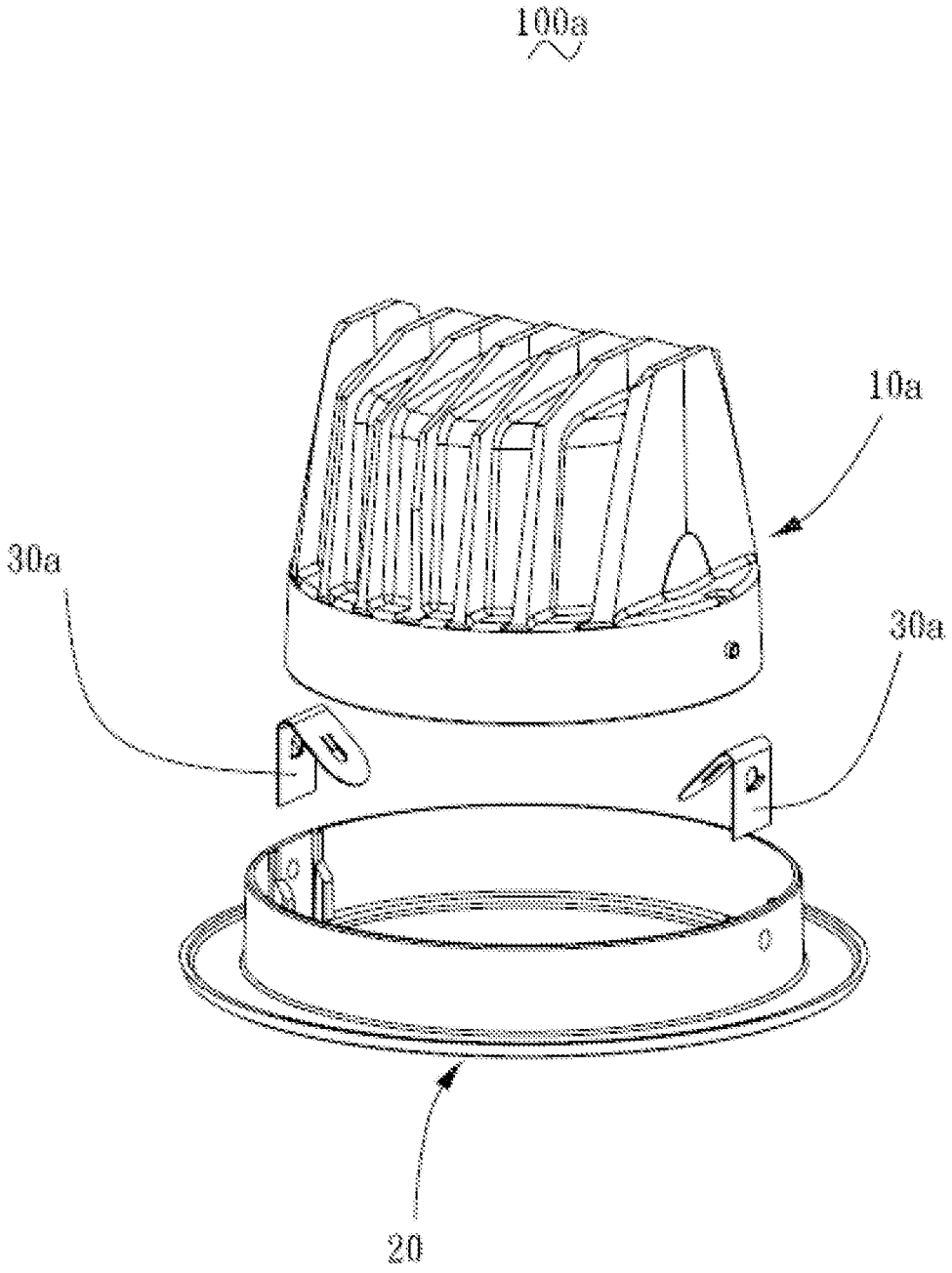
FIG. 7 is a stereoscopic exploded view of a lighting fixture according to a second embodiment of the present invention.
Figure 8:
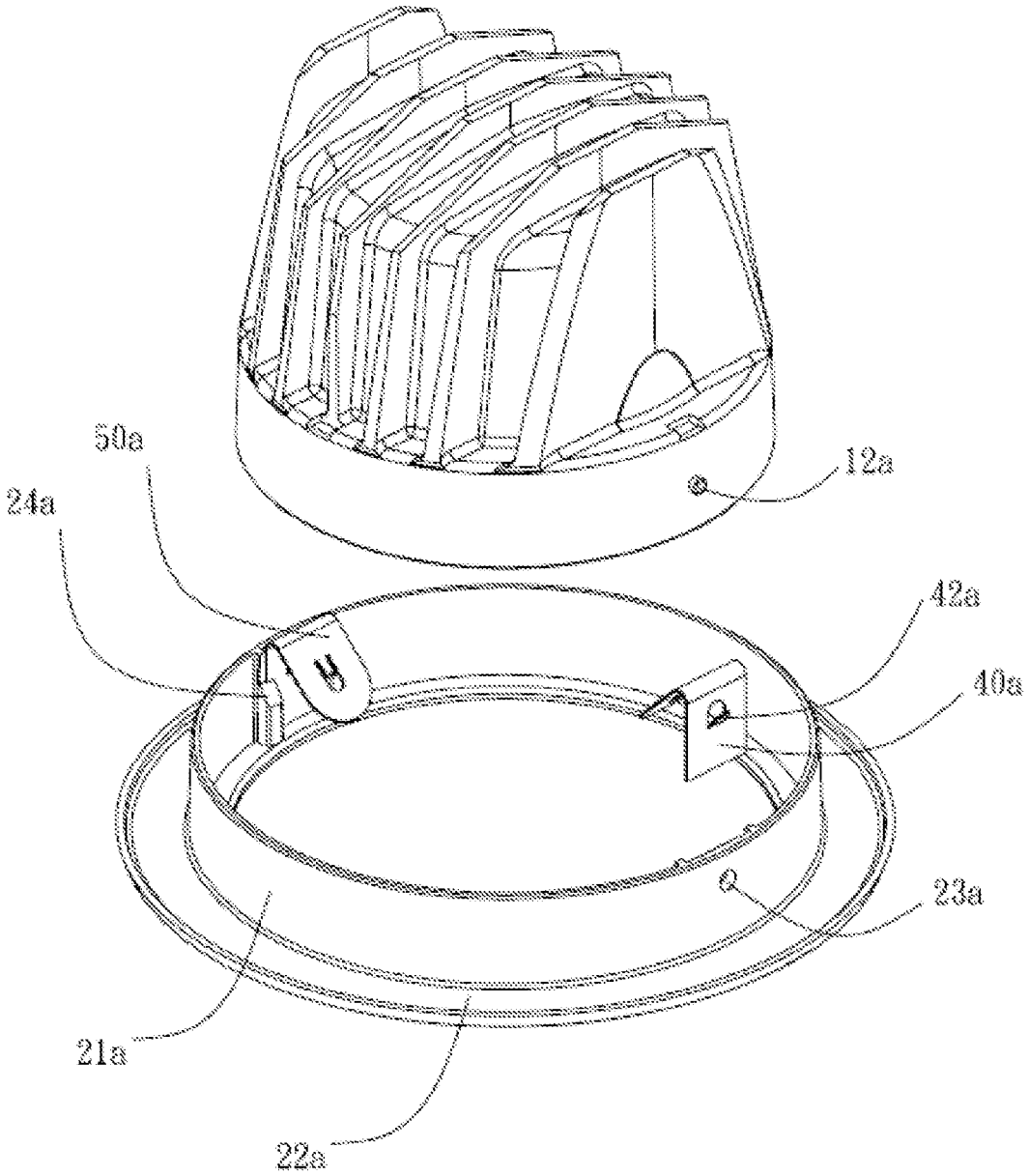
FIG. 8 is a partial assembly diagram of the lighting fixture of FIG. 7.
Figure 9:
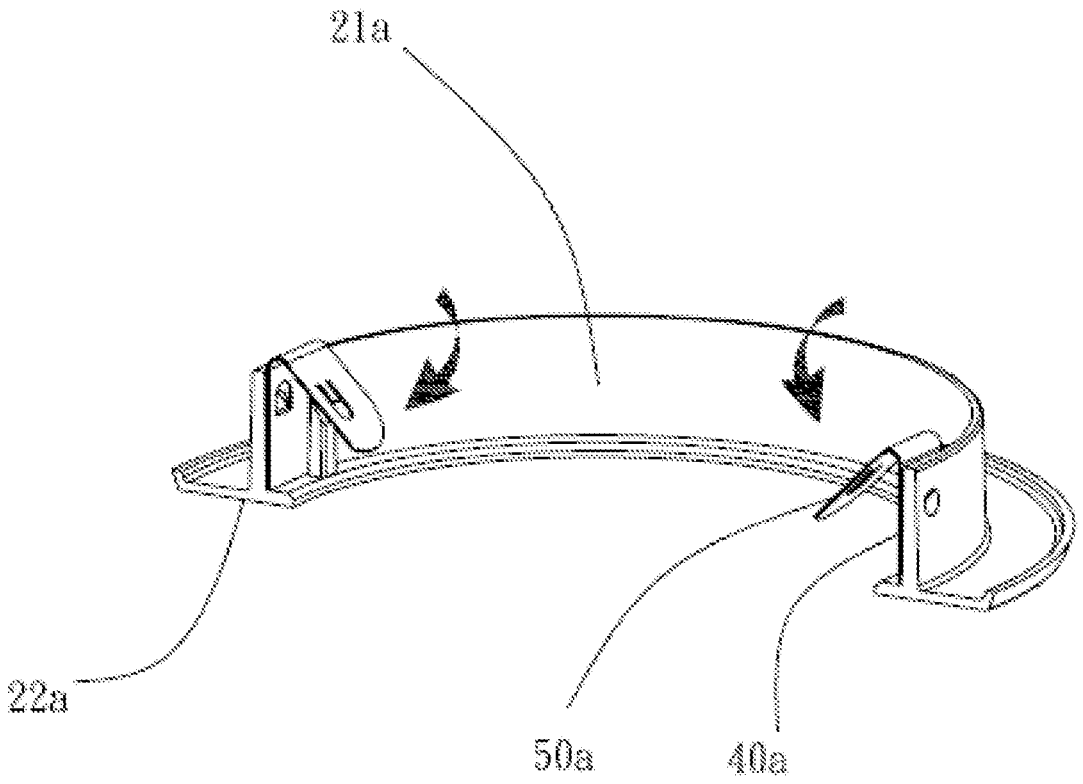
FIG. 9 is a stereoscopic diagram of the lighting fixture of FIG. 7 after splitting half of a frame and mounting the elastic sheets.
Figure 10:
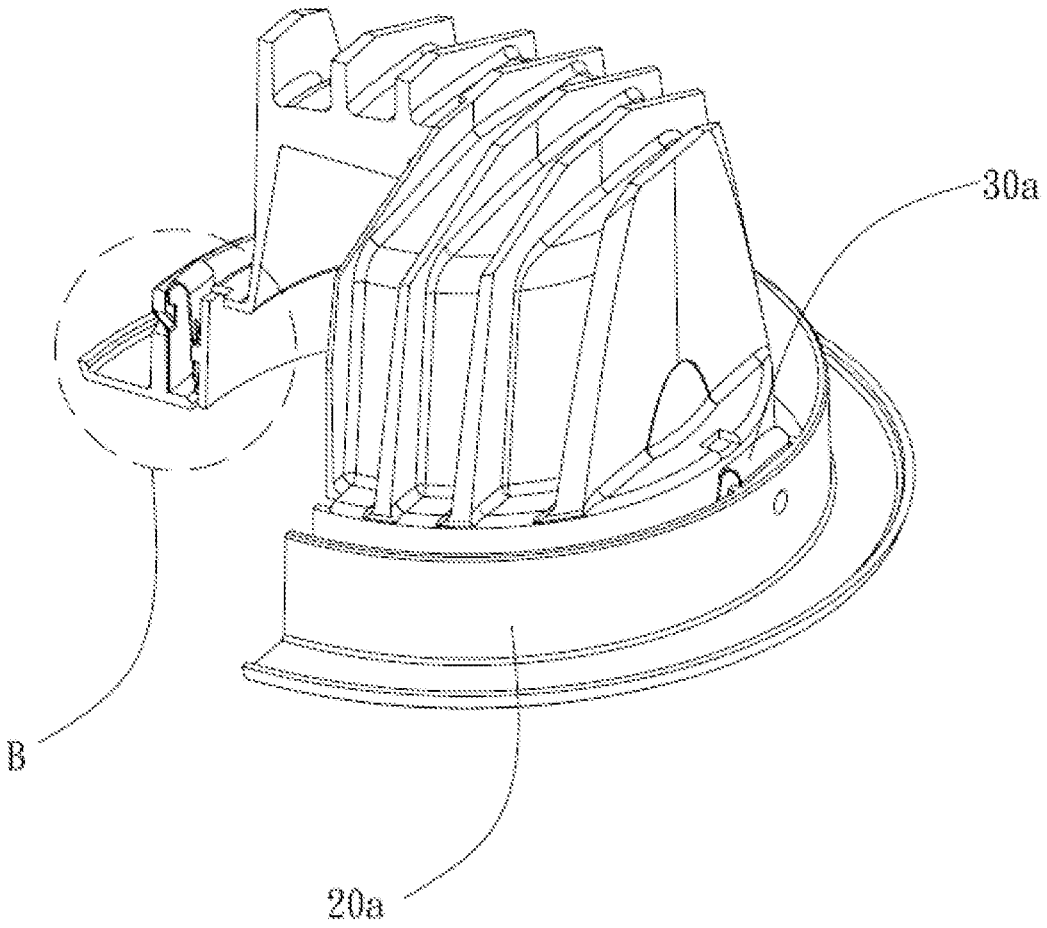
FIG. 10 is a stereoscopic diagram of the assembled lighting fixture of FIG. 7 after removing a quarter thereof.
Figure 11:
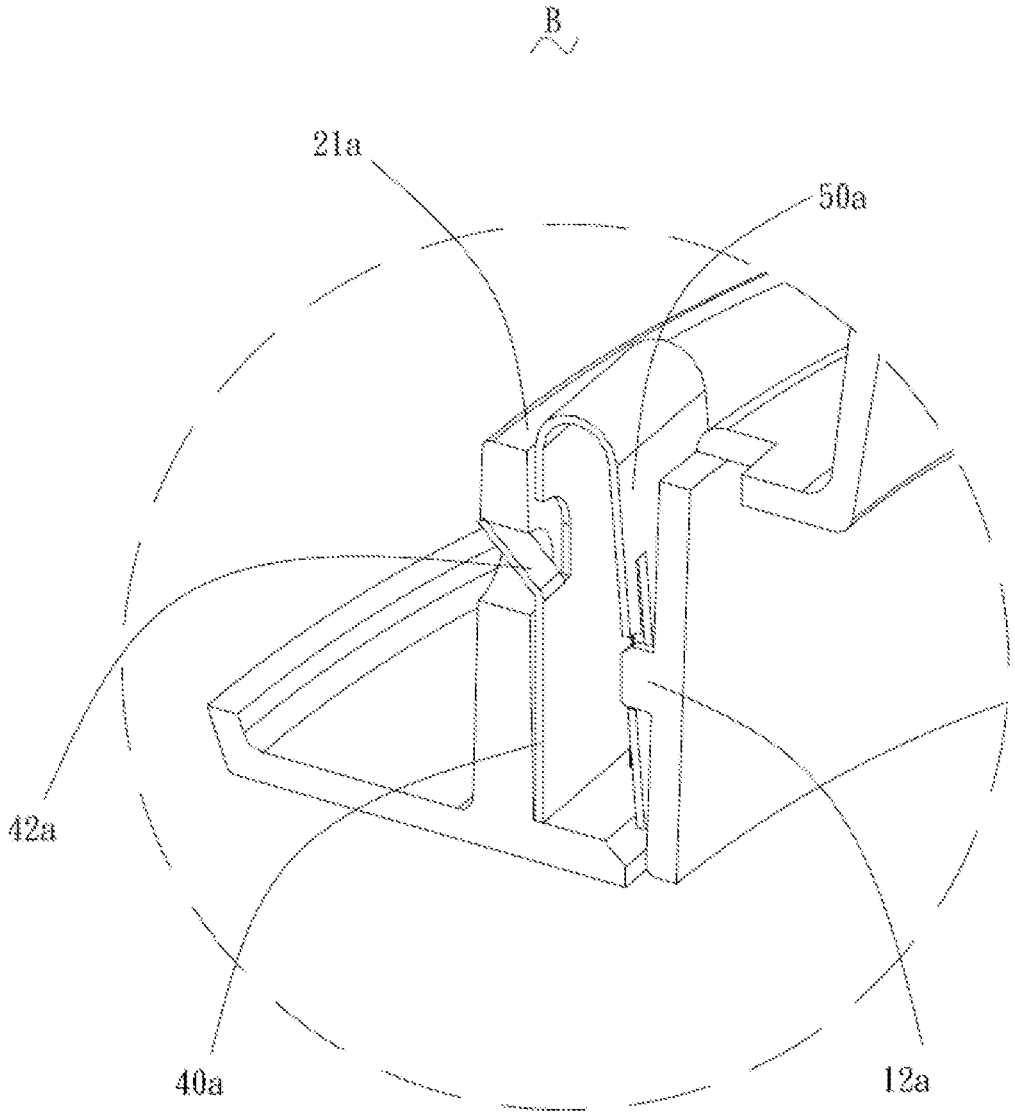
FIG. 11 is an enlarged view of circle part B of FIG. 10.

As shown FIGS. 7-11, a lighting fixture 100*a* according to a second embodiment of the present invention is shown. The lighting fixture 100*a* includes a lamp body 10*a*, a frame 20*a* and two elastic sheets 30*a* for connecting the lamp body 10*a* and the frame 20*a*.

The structure of the lamp body 10*a* is the same as the lamp body 10 of the lighting fixture 100 in the second embodiment, and the lamp body 10*a* includes bosses 12*a* extending outward relative to each other; similar to the frame 20 in the first embodiment, the frame 20*a* includes a frame body 21*a* and a pedestal 22*a*, and the frame body 21*a* is provided thereon with two opposite positioning holes 23*a* and engaging seats 24*a* with sockets 240*a* provided thereon; however, the difference lies in that the two engaging seats 24*a* in the second embodiment are disposed on the inner wall of the frame body 21*a*, and the openings of the sockets 240*s* are inward. The elastic sheets 30*a* include main body portions 40*a* and buckle portions 50*a*, with the main body portions 40*a* including tongues 42*a*. Different from the tongues 42 extending toward the buckle portions 50 in the first embodiment, the tongues 42*a* extend away from the buckle portions 50*a*. The buckle portions 50*a* are the same as the buckle portions 50 in the first embodiment and will not be repeated here.

The foregoing embodiments merely show an implementation way of the present invention and are described more specifically and in more details, and will not be regarded as any limitation to the scope of the present invention. It is to be noted that, for an ordinary person of skill in the art, various variants and improvements may be made without departing from the idea of the present invention, and those variants and improvements shall fall into the protection scope of the present invention. Therefore, the protection scope of the present invention shall be subject to the appended claims.

What is claimed is:

1. A lighting fixture comprising:

a lamp body including an outer wall having bosses provided on opposite sides of the outer wall;

a frame body including positioning holes provided at positions corresponding to the bosses, and engaging seats corresponding to the positioning holes;

at least two elastic sheets each including a main body portion with an obliquely protruded tongue, and a buckle portion connected to the main body portion, with a neck and a fork provided on the buckle portion;

wherein lamp body is configured to be coupled to the frame body by inserting the main body portions into the engaging seats of the frame body and fixed in the positioning hole by the tongue, the bosses being disposed in the necks of the buckle portions, the forks being elastically against the corresponding bosses, the buckle portions of the elastic sheets being against the outer wall of the lamp body.

2. The lighting fixture according to claim 1, wherein the buckle portions comprise arc elastic portions for connecting to the tops of the main body portions, and the buckle portions, the elastic portions and the main body portions are in an inverse V shape.

3. The lighting fixture according to claim 1, wherein each engaging seat is disposed on the inside surface of the frame body, and the tongue in the main body portion of each elastic sheet obliquely extends away from the buckle portion.

4. The lighting fixture according to claim 1, wherein the buckle portions are provided with two slots communicated with the necks, and the slots are positioned on two opposite sides of the forks, respectively, to increase the elasticity of the forks.

5. The lighting fixture according to claim 4, wherein the bosses are cylindrical, and the bottom edges of the forks are concave arcs to correspondingly lean against the bosses.

6. The lighting fixture according to claim 1, wherein each engaging seat comprises two positioning bars that are disposed on two opposite sides of the corresponding positioning hole, and a T-shaped socket is formed by the two positioning bars of each engaging seat and the corresponding part of the frame body.

7. The lighting fixture according to claim 6, wherein each positioning bar is a vertical bar and comprises a connection portion connected to the frame body and a stop portion extending from the outer edge of the connection portion to the other positioning bar, and each positioning bar has an L-shaped cross section.

8. The lighting fixture according to claim 1, wherein each engaging seat is disposed on the outside surface of the frame body, and the tongue in the main body portion of each elastic sheet obliquely extends toward the buckle portion.

9. The lighting fixture according to claim 8, wherein the buckle portions comprise arc elastic portions for connecting the tops of the main body portions, and the elastic portions span over the top edges of the frame body to connect the main body portions and the buckle portions, respectively.

10. The lighting fixture according to claim 8, wherein each elastic sheet further comprises an operating portion including an arc portion for connecting the bottom of the main body portion, and notches are provided on two sides of the bottom of the main body portion, respectively.

* * * * *